United States Patent [19]

Fosnaught

[11] Patent Number: 4,604,154

[45] Date of Patent: Aug. 5, 1986

[54] APPARATUS AND METHOD FOR GUIDING PLASTIC LABELS TO A LABEL-WRAPPING STATION

[75] Inventor: Harold R. Fosnaught, Perrysburg, Ohio

[73] Assignee: Owens-Illinois, Inc., Toledo, Ohio

[21] Appl. No.: 555,788

[22] Filed: Nov. 28, 1983

[51] Int. Cl.[4] ..... B65C 3/16; B65C 9/18

[52] U.S. Cl. ..... 156/264; 156/215; 156/450; 156/497; 156/521; 156/568; 156/DIG. 13; 156/DIG. 26; 156/DIG. 33

[58] Field of Search ..... 156/264, 517, 521, 568, 156/215, 450, 497, DIG. 13, DIG. 26, DIG. 33; 271/276, 314

[56] References Cited

U.S. PATENT DOCUMENTS

| | | | |
|---|---|---|---|
| 4,029,537 | 6/1977 | Kish | 271/276 |
| 4,323,416 | 4/1982 | Malthouse et al. | 156/521 |
| 4,500,386 | 2/1985 | Hoffman | 156/568 |

*Primary Examiner*—Michael Wityshyn
*Attorney, Agent, or Firm*—John R. Nelson

[57] ABSTRACT

Apparatus for feeding plastic label stock, regardless of curling, to a label-wrapping station is disclosed. The apparatus and method include a first label guide means including a turning bar that directs the plastic label sheet from a supply roll towards a rotary vacuum drum in the label-wrapping station, knife means for cutting the label sheet into desired lengths to form labels, secondary guide means for guiding the label to the vacuum drum periphery, and final guide means to positively turn the label back into the drum periphery, especially during start-up, and regardless of curl.

6 Claims, 5 Drawing Figures

APPARATUS AND METHOD FOR GUIDING PLASTIC LABELS TO A LABEL-WRAPPING STATION

The present invention relates to an apparatus and method for wrapping a plastic label around a container.

In the past, plastic labels including a foam layer have been wrapped around containers such as oriented plastic containers by guiding the plastic label toward a label-wrapping station. The labels are subject to curling which interferes with this feeding and guiding of the label towards the label-wrapping station.

It is an object of the present invention to provide an apparatus and method for wrapping a plastic label around a container at a label-wrapping station, the apparatus and method including means for feeding and guiding the labels to the label-wrapping station on a continuous production basis regardless of the curling of the label.

It is an object of the present invention to provide an apparatus and method of assuring positive placement of a plastic label, regardless of curl, on a vacuum drum used to feed the label to a label-wrapping station to provide a plastic label around a container.

It is an object of the present invention to provide an apparatus for feeding a coextruded polystyrene label stock regardless of curling to a label-wrapping station for cutting and wrapping a length of the label stock around a container, the label being a sheet and having an outer solid polystyrene layer and an inner foam layer for contact with the container, the apparatus comprising means for transporting the label sheet with its length axis substantially parallel to the horizontal; a first means for sharply turning the label sheet by the use of a turning bar strategically located and so arranged on the periphery of a rotating member that includes a knife also on the periphery. As the turning bar rotates past the stationary knife blade, the primary feed guide applies a spring pressure against the label sheet, thus as the turning bar passes this point the label sheet is sharply turned into a secondary feed guide; a second means for guiding the label sheet to a rotating vacuum drum for rotating the label around its periphery to the label-wrapping station, the secondary feed guide being so constructed that the label sheet is applied directly to the periphery of the rotating vacuum drum; and a third means for guiding the sheet to the label-wrapping station including a final feed guide to move the label back into the vacuum drum for a positive placement and guidance of the label regardless of curling of the label.

These and other objects of the present invention will be apparent from the specification that follows, the appended claims, and the drawings in which:

Figure 1:
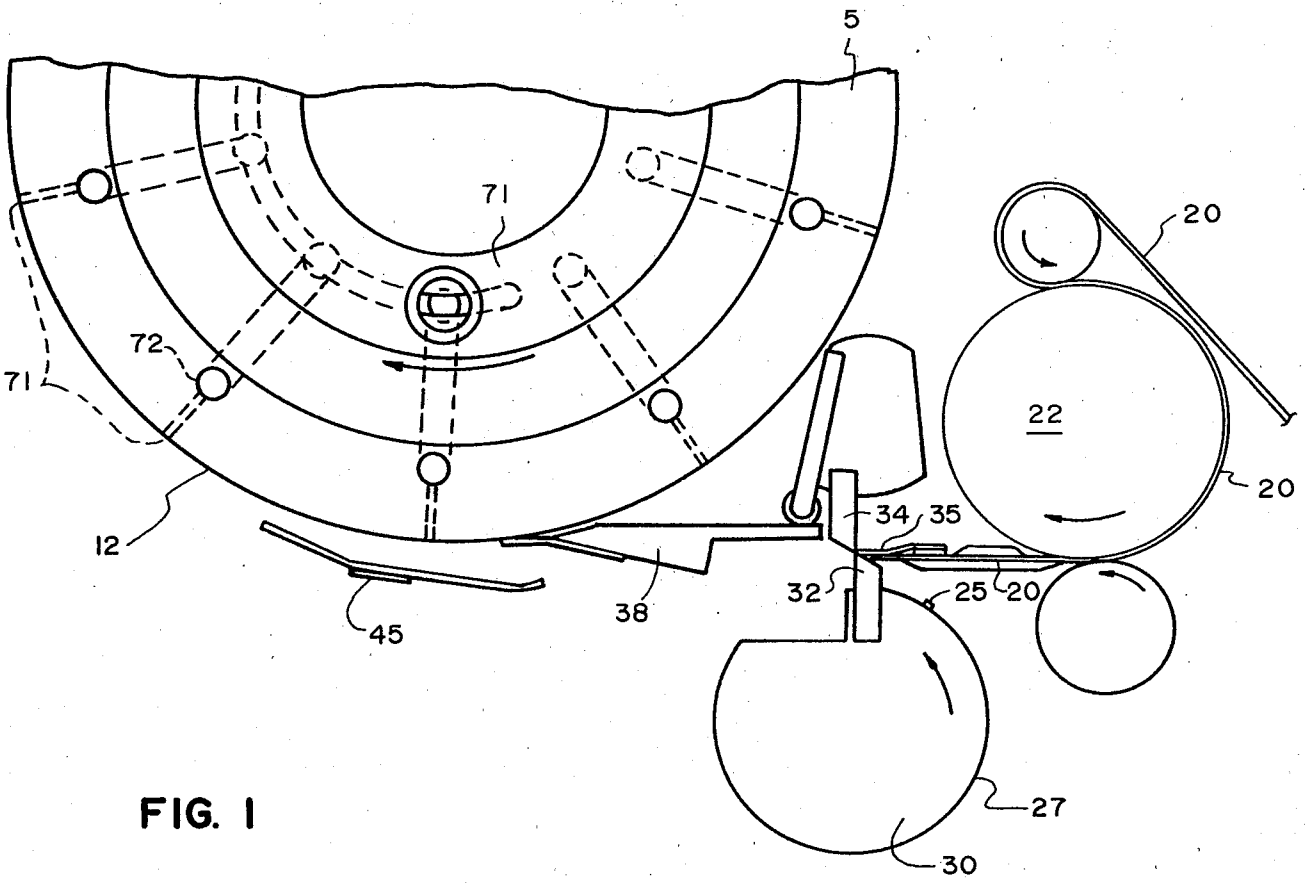
FIG. 1 is a fragmentary top plan view of the positive label placement apparatus of the present invention showing the knife in a position to cut a desired length of plastic label sheet.
Figure 4:
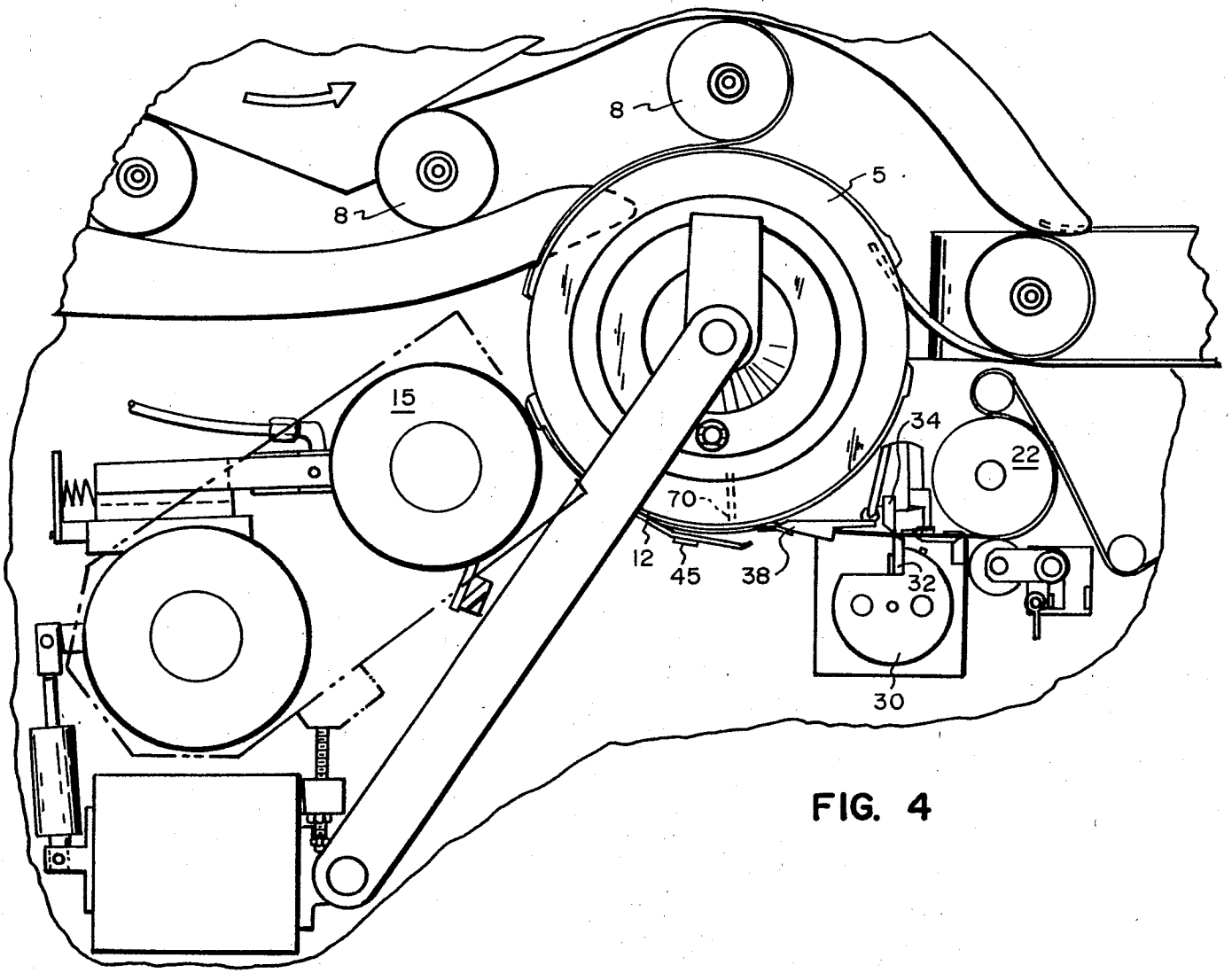
Figure 5:
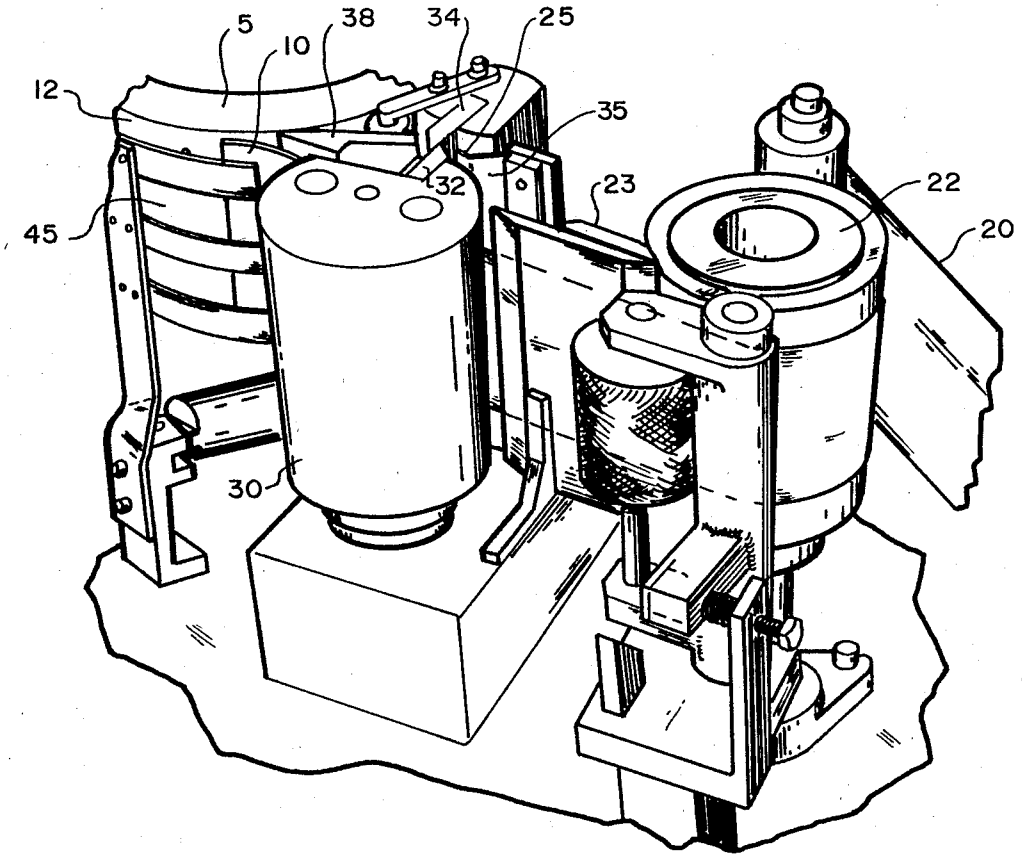

FIG. 4 is a fragmentary top plan view including the apparatus of FIG. 1 and showing a gravure roll that applies solvent to the label as it travels around the periphery of the vacuum drum towards a label-wrapping station; and FIG. 5 is a fragmentary perspective view of the apparatus showing the label guide, the secondary guide and the final guide for directing label material from the feed roll to the vacuum drum.

The present invention provides an apparatus including positive label guide means to provide for transfer and placement of the label material to a vacuum drum of a label-wrapping station regardless of the curling characteristics of the label. The novel apparatus includes a first label guide means, a secondary guide means and a final guide means.

The present invention also provides a method of feeding to a label-wrapping station a polystyrene label sheet stock comprising a solid polystyrene layer and a foam polystyrene layer, regardless of the amount of curl, the method comprising the steps of: transporting the sheet to the wrapping station with the length axis of the sheet substantially parallel to the horizontal; directing the sheet into a secondary feed guide by passing the sheet between a primary feed guide and a turning bar, cutting the sheet into desired lengths to form labels with a knife while the sheet is moving, steering the labels towards a rotary vacuum drum and placing the label on the drum periphery, changing abruptly the path of the label whereby it feeds into the drum periphery, and finally guiding the label around the periphery of the drum with a final guide means to supply the moving label to the wrapping station regardless of curl of the label.

As seen in the drawings, a vacuum drum 5 is provided in a label-wrapping station for a container 8. A plastic label 10 is disposed around the periphery 12 of the vacuum drum 5 in the label-wrapping station. A gravure roll 15 is adapted to apply solvent to one side of the label as it rotates around the vacuum drum to be wrapped around the container.

The apparatus and methods for rolling a container around a label using a solvent-seal system are described in a U.S. patent application Ser. No. 555,758 of Harold R. Fosnaught, filed the same date as this application, and entitled "Apparatus and Method for Wrapping a Plastic Label around a Container", the application being assigned to the same assignee as the present invention and incorporated herein by reference.

Figure 2:
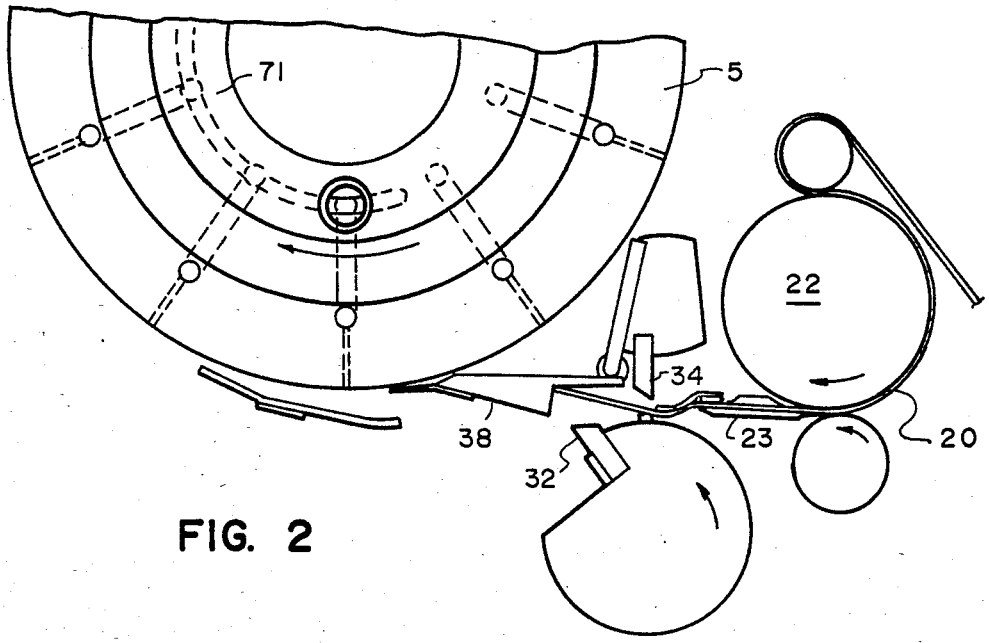
FIG. 2 is a fragmentary plan view of the apparatus of FIG. 1 showing the turning bar directing the cut label towards a secondary guide means.
Figure 3:
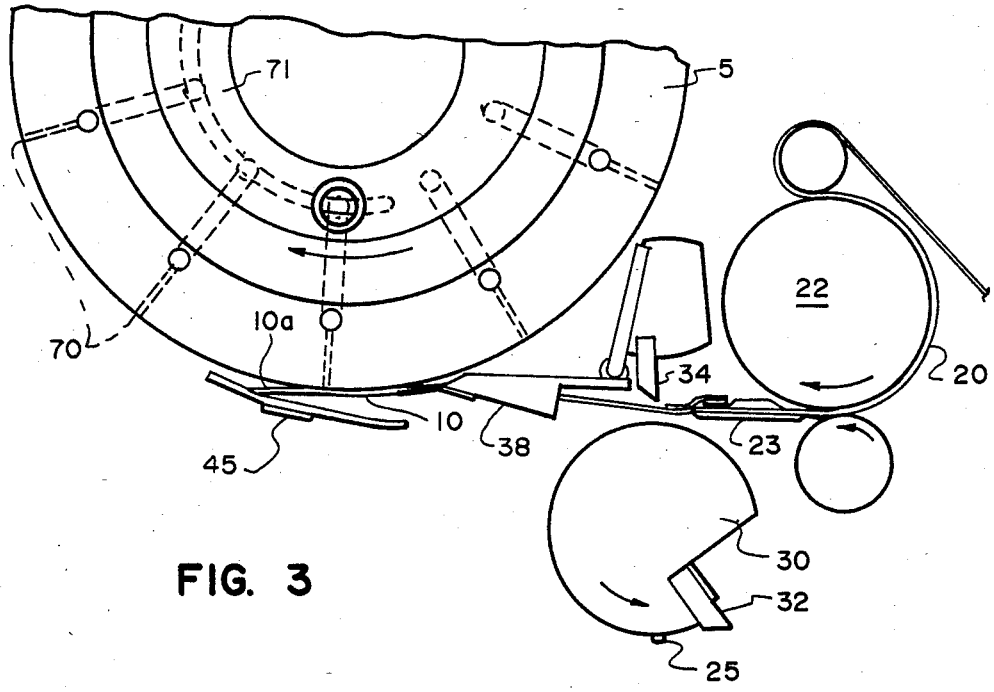
FIG. 3 is a fragmentary plan view of the apparatus of FIG. 1 showing the label being positively directed and guided to the periphery of the vacuum drum.

As best seen in FIGS. 1, 2 and 3, a plastic label such as a coextruded polystyrene sheet 20 having a solid polymer layer and a foam polymer layer is transported towards a label-wrapping station by a feed roll 22, the label sheet 20 generally having its length axis substantially parallel to the horizontal.

There is provided a first means for directing the sheet including a first label guide means 23 and a turning bar 25 mounted on an outer periphery 27 of a rotary member 30. The rotary member also has a knife 32 mounted on its periphery for contacting the sheet 20 at the anvil 34 for cutting the sheet 20 into desired label lengths 10. The sheet 20 is guided by the action of the turning bar 25 and a primary feed guide 35 as the sheet passes the rotating member 30. A secondary guide means 38 is provided to guide the sheet to the rotating vacuum drum. The turning bar 25, primary feed guide 35 and secondary feed guide 38 are so constructed and arranged that the label is turned sharply from its path into the secondary feed guide as shown in FIG. 2.

The secondary feed guide, as shown in FIG. 2, directs and applies the cut label 10 to the vacuum drum periphery 12 for rotation around the drum whereby the container 8 is rolled around the periphery to provide a label therefor, the label generally having indicia printed on its upper surface 10*a*, this printed surface being adjacent the vacuum drum periphery and becoming the outer label surface when the container is rolled around the label. The underside of the label is exposed as the label travels on the drum 5, the underside having applied thereto a solvent for the polymer of the label to lightly tack the leading edge to the container for wrapping and to provide a solvent-seal side seam for the wrapped label.

A third and final guide means 45 is provided to help guide and direct the leading edge of the label to the drum periphery. This final positive placement means 45 is used to assist the vacuum of the rotary vacuum drum 5 to hold the label on the drum periphery. Especially on start-up, when the vacuum is not up to full capacity, the final guide directs the laebel back into the vacuum drum periphery regardless of the curl of the label. Thus the label is pulled toward the interior of the drum by pulling a vacuum in the drum interior and providing ports 70 that communicate with a manifold 71 in the interior of the drum, the label also being directed toward the drum periphery by the final guiding of the label by the final guide 45.

What is claimed is:

1. An apparatus for feeding a coextruded polystyrene label stock regardless of curling to a label-wrapping station for cutting and wrapping a length of the label stock around a container, the label being a sheet and having an outer solid polystyrene layer and an inner foam layer for contact with the container, the apparatus comprising:

means for transporting the label sheet with its length axis substantially parallel to the horizontal; a first label guide means for guiding the sheet towards the label-wrapping station by pushing against one side of the sheet, a rotating member located on the other side of the sheet, the rotating member including a knife for cutting the sheet into labels on the periphery of the member and a turning bar behind the knife on the periphery, the turning bar, after the label is cut from the sheet, pushing against the sheet from the side opposite the first guide means to turn the label from its path into a second guide means, the knife thus rotating and contacting the sheet to cut the sheet into desired lengths of label sheets to form labels and each label is positively guided into the second guide means, the second guide means guiding each of the cut label sheets into a rotating vacuum drum, the second guide means being so constructed and arranged that the label is applied directly to the vacuum drum for rotating the label around its periphery to the label-wrapping station; and a third means for guiding the sheet to the label-wrapping station including a final feed guide to move the label into the vacuum drum for a positive placement and guidance of the label even during start-up regardless of curling of the label.

2. An apparatus as defined in claim 1 in which the means for transporting the sheet includes a rotating feed stock roll, the sheet being pulled from the feed stock roll by the rotation of the feed stock roll and the rotating member.

3. An apparatus as defined in claim 1 in which the vacuum drum has a plurality of ports on its periphery, the ports communicating with the interior of the drum whereby a vacuum is pulled through the ports from the drum interior.

4. An apparatus as defined in claim 3 in which the final feed guide of the third means guides the label into the drum periphery during start-up to assist the pulling of the label around the periphery of the pulling of a vacuum.

5. A method of feeding to a label-wrapping station a polystyrene label sheet stock comprising a solid polystyrene layer and a foam polystyrene layer, regardless of the amount of curl, the method comprising the steps of:

A. transporting the sheet to the wrapping station with the length axis of the sheet substantially parallel to the horizontal;

B. guiding the sheet with a primary feed guide towards a rotating member with a knife for cutting the sheet into labels;

C. pushing against one side of the sheet as the sheet is moving with the primary feed guide;

D. cutting the sheet into desired lengths to form labels with the knife while the sheet is moving;

E. pushing against the cut sheet on the other side of the sheet with a turning bar located on the rotating member;

F. turning the cut label from its path after being pushed by the primary guide towards a secondary guide means and steering the label;

G. steering the label towards a rotary vacuum drum with the secondary guide means and placing the label on the drum periphery; and H. finally guiding the label around the periphery of the drum with a final guide means to supply the moving label to the wrapping station regardless of curl of the label.

6. A method as defined in claim 5 including the step of pulling the label toward the center of the vacuum drum by drawing a vacuum on the interior of the drum and pulling the label against a port on the drum periphery.

* * * * *